US007112149B2

(12) United States Patent
Sajima et al.

(10) Patent No.: US 7,112,149 B2
(45) **Date of Patent: *Sep. 26, 2006**

(54) GOLF BALL

(75) Inventors: Takahiro Sajima, Kobe (JP); Seiichiro Endo, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/933,303

(22) Filed: Sep. 3, 2004

(65) Prior Publication Data

US 2005/0101412 A1 May 12, 2005

(30) Foreign Application Priority Data

Nov. 7, 2003 (JP) ..... 2003-378885

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,813,677 A 3/1989 Oka et al.
5,072,945 A * 12/1991 Oka et al. ..... 473/384
5,292,132 A 3/1994 Oka
6,508,723 B1 * 1/2003 Shimosaka ..... 473/351
6,558,274 B1 * 5/2003 Shimosaka ..... 473/351
2002/0119838 A1 8/2002 Moriyama et al.
2004/0132551 A1 * 7/2004 Aoyama et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

A golf ball 2 containing dimples A having a diameter of 4.65 mm, dimples B having a diameter of 4.45 mm, dimples C having a diameter of 4.25 mm, dimples D having a diameter of 4.05 mm, dimples E having a diameter of 3.95 mm, dimples F having a diameter of 2.80 mm, and dimples G having a diameter of 2.65 mm. When all the dimples are arranged in decreasing order of the diameter Di, the mean diameter of the dimples ranking in the top 10% is represented by Dx (mm), and the mean diameter of the dimples 8 ranking in the bottom 10% is represented by Dn (mm), whereby Dx/Dn is equal to or greater than 1.30. The standard deviation η of diameters of all the dimples is equal to or less than 0.5% and the mean value of the diameters of all the dimples is equal to or greater than 4.00 mm.

4 Claims, 21 Drawing Sheets

D
B
A
A
B
B
D
A
A
B
D
A
A
D
A
D
A
D

A
B
A
B
A
B

A
A
B
B
A
A
B
B
A
A
B
B

A
B
A
B
B
A
B
A
B
B
A
B
A
B
A

GOLF BALL

This application claims priority on Patent Application No. 2003-378885 filed in Japan on Nov. 7, 2003.

BACKGROUND OF THE INVENTION

1. Field of the Invention

The present invention relates to golf balls. More particularly, the present invention relates to improvement of dimples of golf balls.

2. Description of the Related Art

Golf balls have numerous dimples on the surface thereof. A role of the dimples involves causing turbulent flow separation through disrupting the air flow around the golf ball during the flight. This roll is referred to as a "dimple effect". By causing the turbulent flow separation, a separating point of air from the golf ball shifts backwards leading to the reduction of drag. The turbulent flow separation promotes the differentia between the separating points at the upper and lower sides of the golf ball, which results from the backspin, there by enhancing the lift force that acts upon the golf ball. Excellent dimples disrupt the air flow in a more efficient manner.

In an attempt to improve the flight performance, a variety of proposals have been made with respect to the dimples. U.S. Pat. No. 5,292,132 discloses a golf ball with very densely arranged dimples. U.S. Pat. No. 4,813,677 discloses a golf ball having a dimple pattern with combined dimples having a great diameter and dimples having a small diameter. U.S. patent Publication No. 2002-119838 discloses a golf ball with a dimple of large size.

The greatest concern for golf balls to golf players is the flight distance. In light of the desire to improve flight distance, there is room for improvement in the construction of golf ball dimples. Thus, an object of the present invention is to provide a golf ball which contains improved dimple design and construction and correspondingly excellent flight performance.

SUMMARY OF THE INVENTION

A golf ball according to the present invention has three different kinds of dimples, each having a different diameter, on the surface thereof. The occupation ratio of the total area of the dimples in the surface area of a phantom sphere is equal to or greater than 75%. When a mean diameter of dimples having a diameter ranking in the top 10% of the diameters of all the dimples is defined as Dx and a mean diameter of dimples having a diameter ranking in the bottom 10% of the diameters of all the dimples is defined as Dn, the ratio Dx/Dn is equal to or greater than 1.30. The standard deviation $\eta$ of the diameters of all the dimples is equal to or less than 0.52.

Preferably, the mean value of the diameters of all the dimples is equal to or greater than 4.00 mm. Preferably, the golf ball has five or more kinds of dimples, each having a different diameter, disposed on the surface thereof.

According to the golf ball of the present invention, it is speculated that Dx/Dn ratio being equal to or greater than 1.30 is responsible for a reduction of the drag. According to the present golf ball, it is speculated that the standard deviation $\eta$ being equal to or less than 0.52 is responsible for the enhancement of the lift force. Thus the golf ball is excellent in flight performance.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The present invention is hereinafter described in detail with appropriate reference to the accompanying drawings according to the preferred embodiments of the present invention.

Figure 1:
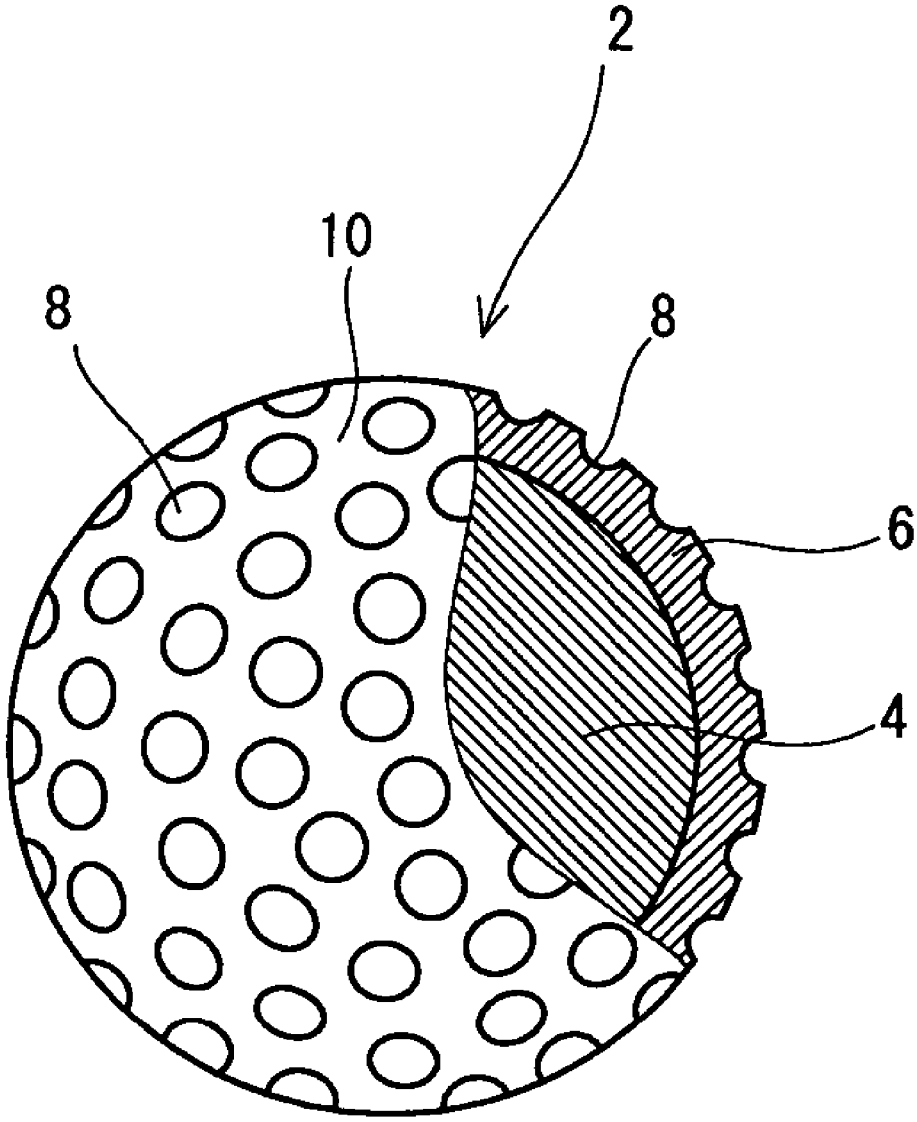
FIG. 1 is a schematic cross-sectional view illustrating a golf ball according to one embodiment of the present invention.

A golf ball 2 depicted in FIG. 1 has a spherical core 4 and a cover 6. Numerous dimples 8 are formed on the surface of the cover 6. Of the surface of the golf ball 2, the part other than the dimples 8 is the land area 10. Although this golf ball 2 has a paint layer and a mark layer in the external side of the cover 6, these layers are not shown in the Figures.

The golf ball 2 has a diameter of from 40 mm to 45 mm. From the standpoint of conformity to a rule defined by United States Golf Association (USGA), the diameter is preferably equal to or greater than 42.67 mm. In light of the reduction of the air resistance, the diameter is preferably equal to or less than 44 mm, and more preferably equal to or less than 42.80 mm. The weight of this golf ball 2 is 40 g or greater and 50 g or less. With a view of attaining a great inertia, the weight is preferably equal to or greater than 44 g, and particularly preferably equal to or greater than 45.00 g. From the standpoint of conformity to a rules defined by the USGA, the weight is preferably equal to or less than 45.93 g.

The core 4 is formed through the crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking the core 4, a co-crosslinking agent is usually used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, sulfur, an anti-aging agent, a coloring agent, a plasticizer, a dispersant and the like may be blended in an appropriate amount to the rubber composition, as needed. Crosslinked rubber powder or synthetic resin powder may be blended to the rubber composition.

The core 4 has a diameter of-equal to or greater than 30.0 mm, and particularly equal to or greater than 38.0 mm. The core 4 has a diameter equal to or less than 42.0 mm, and particularly equal to or less than 41.5 mm. The core 4 may be composed of two or more layers.

Examples of suitable polymers for use in the cover 6 include ionomer resins. In particular, copolymers of a-olefin and an α,β-unsaturated carboxylic acid having 3 to 8 carbon atoms in which a part of the carboxylic acid is neutralized with a metal ion are suitable. The preferable α-olefm are ethylene and propylene. The preferable α,β-unsaturated carboxylic acids are acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, particularly suitable metal ions are the sodium ion, the zinc ion, the lithium ion and the magnesium ion.

In stead of the ionomer resin, or together with the ionomer resin, other polymers may be also used. Illustrative examples of the other polymers include thermoplastic styrene elastomers, thermoplastic polyurethane elastomers, thermoplastic polyarnide elastomers, thermoplastic polyester elastomers and thermoplastic polyolefin elastomers.

To the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent, and the like, in an appropriate amount as needed. The cover 6 may be blended with a powder of a highly dense metal such as tungsten, molybdenum or the like, for the purpose of adjusting the specific gravity.

The thickness of the cover 6 is equal to or greater than 0.5 mm, and particularly equal to or greater than 0.8 mm. The thickness of the cover 6 is equal to or less than 2.5 mm, and particularly equal to or less than 2.2 mm. The specific gravity of the cover 6 is equal to or greater than 0.90, and particularly equal to or greater than 0.95. The specific gravity of the cover 6 is equal to or less than 1.10, and particularly equal to or less than 1.05. The cover 6 may be composed of two or more layers.

Figure 2:
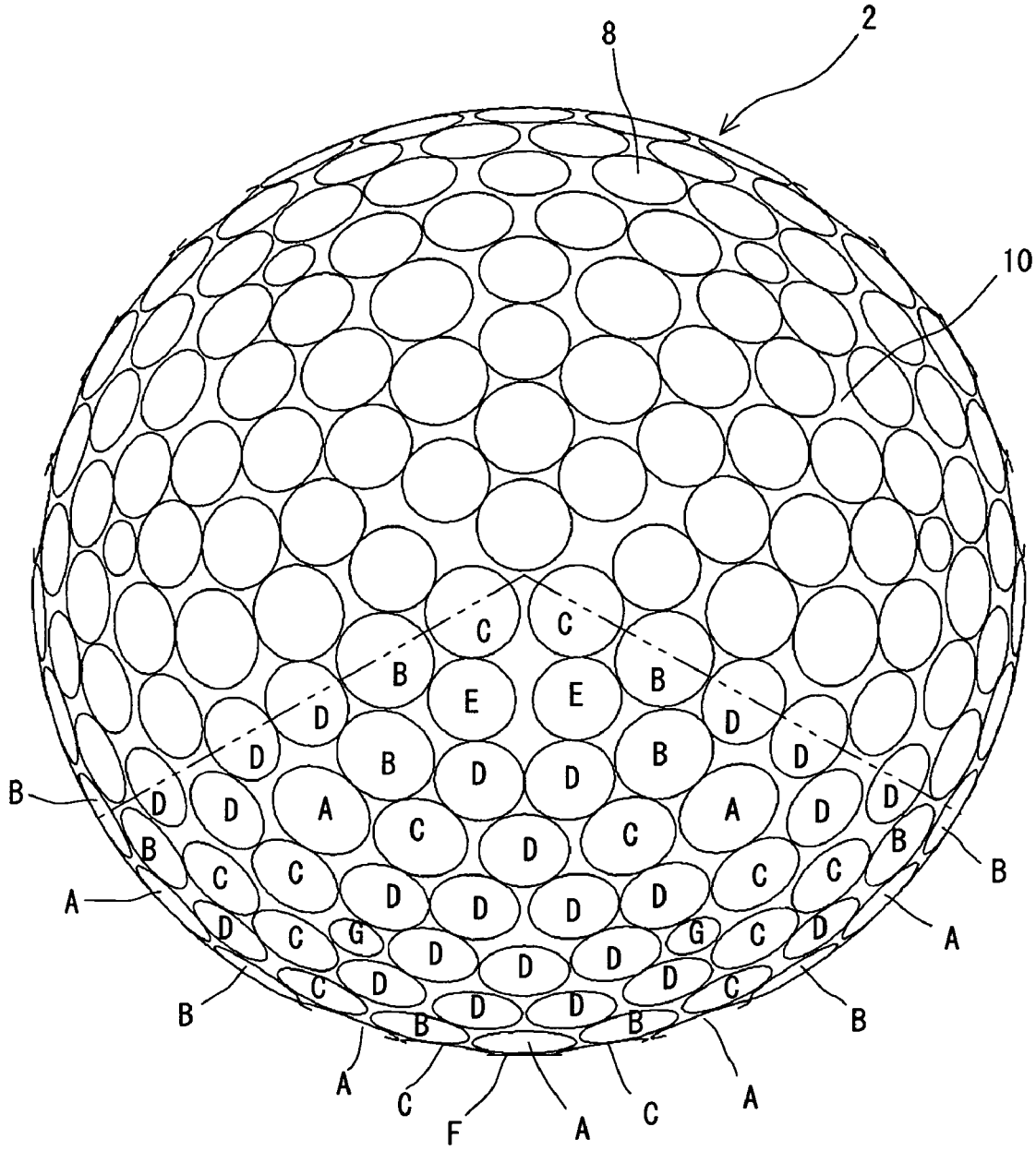
FIG. 2 is an enlarged plan view illustrating the golf ball shown in FIG. 1.
Figure 3:
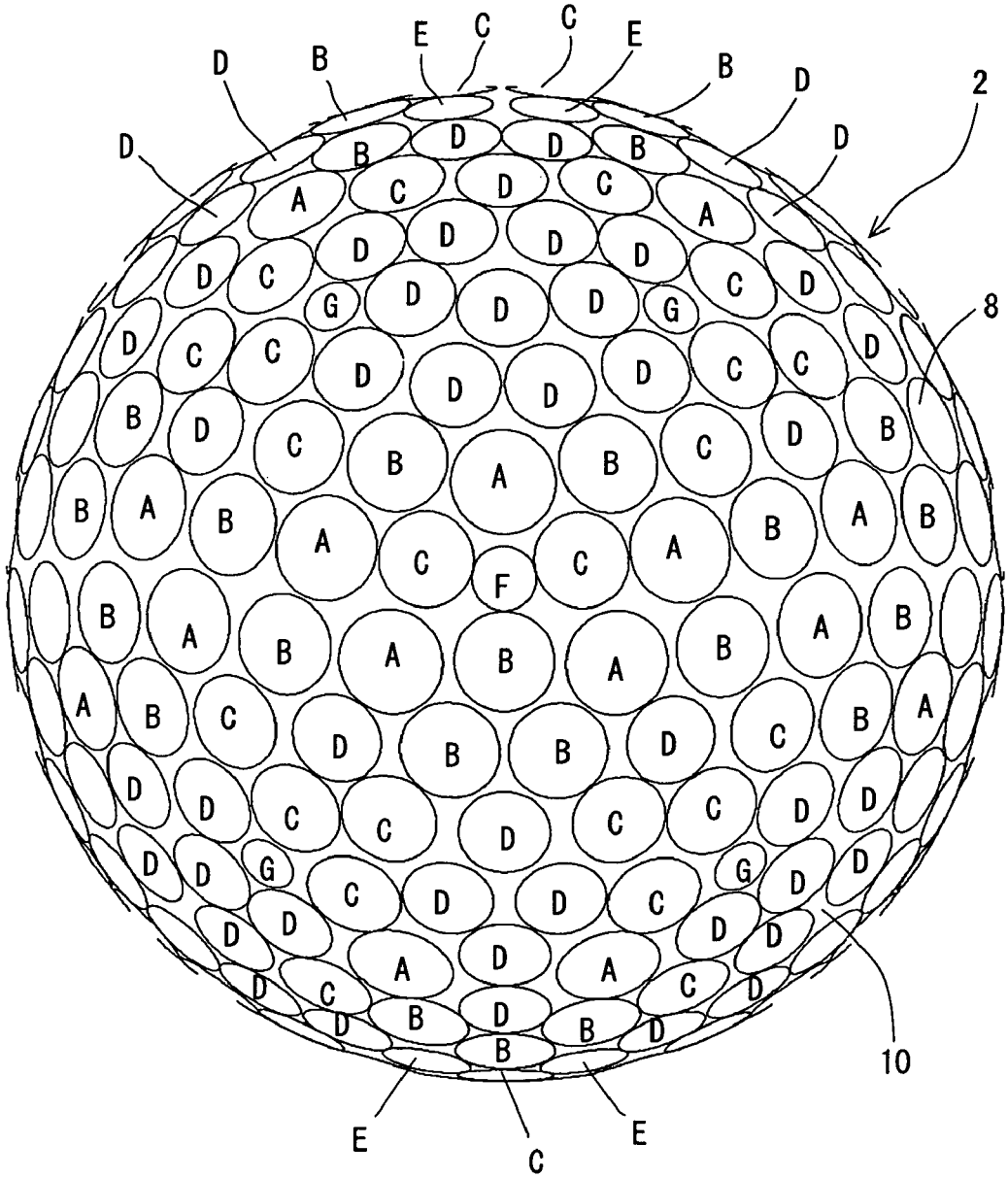
FIG. 3 is a front view illustrating the golf ball shown in FIG. 2.
Figure 4:
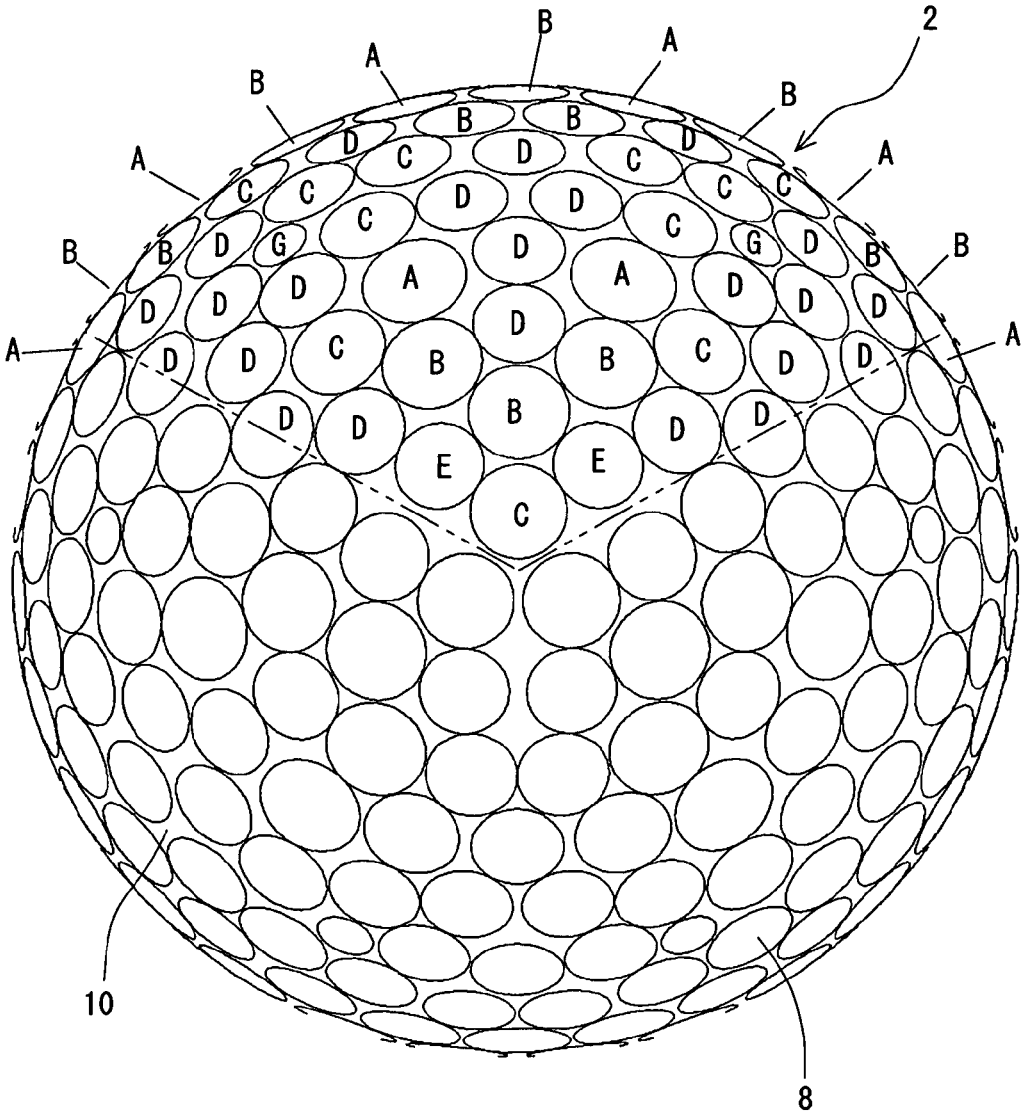
FIG. 4 is a bottom view illustrating the golf ball shown in FIG. 2.

FIG. 2 is an enlarged plan view illustrating the golf ball 2 shown in FIG. 1; FIG. 3 is a front view illustrating the golf ball 2 shown in FIG. 2; and FIG. 4 is a bottom view illustrating the golf ball 2 shown in FIG. 2. As is clear from FIG. 2 to FIG. 4, the plane shape of all the dimples 8 is circular. In FIG. 2 and FIG. 4, the kinds of dimples 8 are depicted by symbols A to G in one unit, provided when the surface of the golf ball 2 is comparted into 6 equivalent units. The golf ball 2 has dimples A having a diameter of 4.65 mm, dimples B having a diameter of 4.45 mm, dimples C having a diameter of 4.25 mm, dimples D having a diameter of 4.05 mm, dimples E having a diameter of 3.95 mm, dimples F having a diameter of 2.80 mm, and dimples G having a diameter of 2.65 mm. Through the combination of multiple kinds of dimples 8, each having a different diameter, the air flow is more efficiently disrupted, thereby reducing the drag. In light of reduction of the drag, it is necessary to provide three or more kinds of dimples 8. It is preferred that five or more kinds, yet 6 or more kinds, and particularly 7 or more kinds of dimples 8 are preferably provided. In light of the ease of production of the mold, 20 or more kinds of dimples are provided. The golf ball 2 shown in FIG. 2 to FIG. 4 has 7 kinds of dimples designated as A to G.

Even though dimples 8 are designed such that they have the same diameter, there may be a case in which found values obtained by the actual measurement of the diameter are different to some extent due to the error caused during the production. According to the present invention, dimples 8 exhibiting the difference between both found values obtained by the actual measurement of the diameter is less than 0.05 mm are regarded to fall within the same kind.

According to the golf ball 2 shown in FIG. 2 to FIG. 4, the number of the dimples A is 42; the number of the dimples B is 66; the number of the dimples C is 72; the number of the dimples D is 126; the number of the dimples E is 12; the number of the dimples F is 3; and the number of the dimples G is 12. Total number of the dimples 8 of this golf ball 2 is 333.

Figure 5:
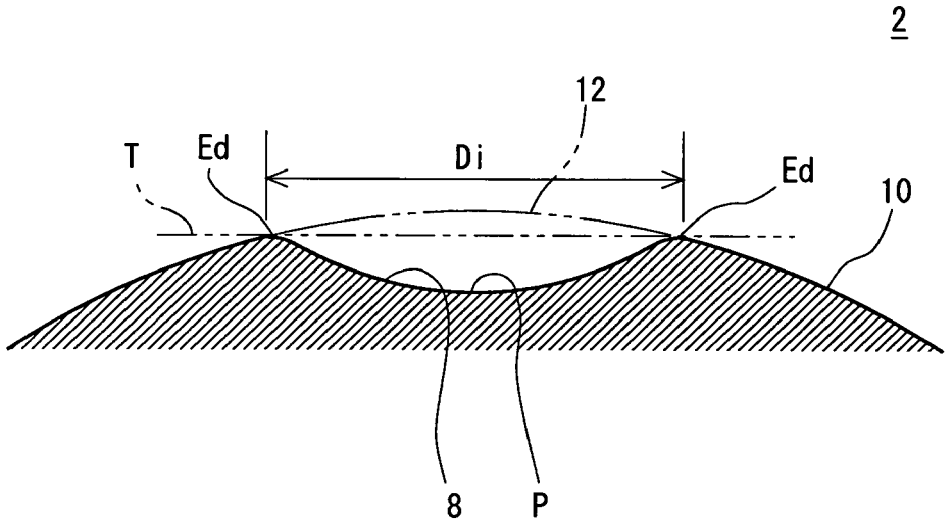
FIG. 5 is an enlarged cross-sectional view illustrating a part of the golf ball shown in FIG. 1.

FIG. 5 is an enlarged cross-sectional view illustrating a part of the golf ball 2 shown in FIG. 1. In this Figure, a face traversing the deepest place P of the dimple 8 and the center of the golf ball 2 is depicted. Vertical direction in FIG. 5 is the in-depth direction of the dimple 8. The in-depth direction refers to a direction from the weighted center of area of the dimple 8 toward the center of the golf ball 2. What is depicted by a chain double-dashed line 12 in FIG. 5 is a phantom sphere. The surface of the phantom sphere 12 corresponds to a surface of the golf ball 2 when it is postulated that there is no dimple 8 existing. The dimple 8 is recessed from the phantom sphere 12. The land 10 agrees with the phantom sphere 12.

What is depicted by the double-sided arrow Di in FIG. 5 is a diameter of the dimple 8. This diameter Di is the distance between one contact point Ed and another contact point Ed, provided when a tangent line T which is common to both sides of the dimple 8 is depicted. The contact point Ed is also an edge of the dimple 8. The edge Ed defines the contour of the dimple 8. The diameter Di is preferably 2.00 mm or greater and 6.0 mm or less. When the diameter Di is less than the above range, the dimple effect is hardly achieved. In this respect, the diameter Di is more preferably equal to or greater than 2.20 mm, and particularly preferably equal to or greater than 2.40 mm. When the diameter Di is beyond the above range, fundamental feature of the golf ball 2 which is substantially a sphere may be compromised. In this respect, the diameter Di is more preferably equal to or less than 5.8 mm, and particularly preferably equal to or less than 5.6 mm.

It is preferred that mean value Da of the diameters Di of all the dimples 8 is equal to or greater than 4.00 mm. A dimple pattern in which the mean value Da is equal to or greater than 4.00 mm results in more efficient disruption of air flow. In this respect, the mean value Da is more preferably equal to or greater than 4.10 mm, and particularly preferably equal to or greater than 4.15 mm. When the mean value Da is too great, fundamental feature of the golf ball 2 which is substantially a sphere may be compromised. In this respect, the mean value Da is preferably equal to or less than 5.00 mm, and more preferably equal to or less than 4.95 mm. The mean value Da in the golf ball 2 shown in FIG. 2 to FIG. 4 is calculated by the following formula:

$$Da = (4.65*42 + 4.45*66 + 4.25*72 + 4.05*126 + 3.95*12 + 2.80*3 + 2.65*12)/333.$$

The mean value Da in this golf ball 2 is 4.18 mm.

According to the present invention, a mean diameter of the dimples 8 ranking in the top 10%, when all the dimples 8 are arranged in decreasing order of the diameter Di, is represented by Dx (mm). Because total number of the dimples 8 of the golf ball 2 shown in FIG. 2 to FIG. 4 is 333, a mean diameter of the dimples 8 ranking in the top 33 is represented by Dx (mm) in this golf ball 2. As described above, this golf ball 2 has 42 dimples A having the diameter Di of 4.65 mm. Therefore, 33 dimples among the dimples A shall fall under the "dimples ranking in the top 10%". According to this golf ball 2, Dx is 4.65 mm.

According to the present invention, a mean diameter of the dimples 8 ranking in the bottom 10%, when all the dimples 8 are arranged in decreasing order of the diameter Di, is represented by Dn (mm). Because total number of the dimples 8 of the golf ball 2 shown in FIG. 2 to FIG. 4 is 333, a mean diameter of the dimples 8 ranking in the bottom 33 is represented by Dn (mm) in this golf ball 2. As described above, this golf ball 2 has six dimples G having the diameter Di of 2.65 mm, three dimples F having the diameter Di of 2.80 mm, 12 dimples E having the diameter Di of 3.95 mm, and 126 dimples D having the diameter Di of 4.05 mm. Thus, dimples G, dimples F and dimples E shall fall under the "dimples ranking in the bottom 10%". Further, six dimples among the dimples D shall also fall under the "dimples ranking in the bottom 10%". Dn in this golf ball 2 is calculated by the following formula:

$$Dn=(2.65*12+2.80*3+3.95*12+4.05*6)/33.$$

According to this golf ball 2, Dn is 3.39 mm.

According to the present invention, Dx/Dn is equal to or greater than 1.30. In other words, the difference in diameters between those of the dimples 8 ranking in the top and the dimples 8 ranking in the bottom is great in this dimples pattern. This dimple pattern is rich in variety. This dimple pattern is speculated to reduce the drag. In this respect, Dx/Dn is more preferably equal to or greater than 1.33, and particularly preferably equal to or greater than 1.36. When Dx is too great, fundamental feature of the golf ball 2 which is substantially a sphere may be compromised. To the contrary, when Dn is too small, dimple effect achieved by the dimples 8 ranking in the bottom 10% may be insufficient. Dx is preferably 3.5 mm or greater and 6.0 mm or less, while Dn is preferably 2.0 mm or greater and 4.0 mm or less. Dx/Dn is preferably equal to or less than 3.00, and more preferably equal to or less than 2.64. Dx/Dn in the golf ball 2 shown in FIG. 2 to FIG. 4 is 1.37.

Standard deviation η of the diameters Di of all the dimples 8 is equal to or less than 0.52. In other words, less fluctuation of frequency distribution of diameters of the dimples 8 is found in this golf ball 2. A dimple pattern with the small standard deviation η irrespective of Dx/Dn being equal to or greater than 1.30 is speculated to cause a great lift force. In this respect, the standard deviation η is more preferably equal to or less than 0.45, and particularly preferably equal to or less than 0.40. Because too small standard deviation η results in insufficient reduction of the drag, the standard deviation η is preferably equal to or greater than 0.15, and particularly preferably equal to or greater than 0.20. Because the mean value Da of diameters Di in the golf ball 2 shown in FIG. 2 to FIG. 4 is 4.18 as described above, the standard deviation η in this golf ball 2 is calculated by the following formula:

$$\eta = (((4.65-4.18)^2*42 + (4.45-4.18)^2*66 + (4.25-4.18)^2*72 + (4.05-4.18)^2*126 + (3.95-4.18)^2*12 + (2.80-4.18)^2*3 + (2.65-4.18)^2*12)/333)^{1/2}.$$

The standard deviation η in this golf ball 2 is 0.39.

The area of the dimple 8 is an area of a region surrounded by the edge line when the center of the golf ball 2 is viewed at infinity (i.e., an area of the plane shape). The area s is calculated by the following formula:

$$s=(Di/2)^2*\pi.$$

In the golf ball 2 shown in FIG. 2 to FIG. 4, the area of the dimple A is 16.98 $mm^2$; the area of the dimple B is 15.55 $mm^2$; the area of the dimple C is 14.19 $mm^2$; the area of the dimple D is 12.88 $mm^2$; the area of the dimple E is 12.25 $mm^2$; the area of the dimple F is 6.16 $mm^2$; and the area of the dimple G is 5.52 $mm^2$.

In the present invention, ratio of summation of areas s of all the dimples 8 occupied in the surface area of the phantom sphere 12 is referred to as an occupation ratio. From the standpoint that a sufficient dimple effect is achieved, the occupation ratio is preferably equal to or greater than 75%, more preferably equal to or greater than 77%, and particularly preferably equal to or greater than 79%. Usually, the occupation ratio is equal to or less than 90%. According to the golf ball shown in FIG. 2 to FIG. 4, total area of the dimples 8 is 4616.1 $mm^2$. Because the surface area of the phantom sphere 12 of this golf ball 12 is 5728.0 $mm^2$, the occupation ratio is 80.6%.

In FIG. 5, a distance between the tangent line T and the deepest place P is the depth of the dimple 8. It is preferred that the depth is 0.05 mm or greater and 0.60 mm or less. When the depth is less than the above range, a hopping trajectory maybe provided. In this respect, the depth is more preferably equal to or greater than 0.08 mm, and particularly preferably equal to or greater than 0.10 mm. When the depth is beyond than the above range, a dropping trajectory may be provided. In this respect, the depth is more preferably equal to or less than 0.45 mm, and particularly preferably equal to or less than 0.40 mm.

According to the present invention, "volume of the dimple" means the volume surrounded by a plane including the contour of the dimple 8 and the surface of the dimple 8. It is preferred that total volume of the dimples 8 is 250 $mm^3$ or greater and 400 $mm^3$ or less. When the total volume is less than the above range, a hopping trajectory may be provided. In this respect, the total volume is more preferably equal to or greater than 260 $mm^3$, and particularly preferably equal to or greater than 270 $mm^3$. When the total volume is beyond the above range, a dropping trajectory may be provided. In this respect, the total volume is more preferably equal to or less than 390 $mm^3$, and particularly preferably equal to or less than 380 $mm^3$.

It is preferred that total number of the dimples 8 is 200 or greater and 500 or less. When the total number is less than the above range, the dimple effect is hardly achieved. In this respect, the total number is more preferably equal to or greater than 240, and particularly preferably equal to or greater than 260. When the total number is beyond the above range, achievement of the dimple effect may be difficult due to small size of the individual dimples 8. In this respect, the total number is more preferably equal to or less than 480, and particularly preferably equal to or less than 460.

EXAMPLES

Example 1

A rubber composition was obtained by kneading 100 parts by weight of polybutadiene (trade name "BR-11", available from JSR Corporation), 24.5 parts by weight of zinc acrylate, 10 parts of zinc oxide, 15 parts by weight of barium sulfate, 0.8 part by weight of dicumyl peroxide. This rubber composition was placed into a mold having upper and lower mold half each having a spherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts of titanium dioxide. The aforementioned core was placed into a mold having numerous protrusions on the inside face, followed by injection of the aforementioned resin composition around the core according to injection molding method to from a cover having a thickness of 2.3 mm. Numerous dimples having a shape inverted from the shape of the protrusion were formed on the cover. Paint was applied on this cover to give a golf ball of Example 1 having a diameter of 42.7 mm and weight of about 45.4 g. Compression of this golf ball was about 85. Specifications of dimples of this golf ball are presented in Table 1 below.

Examples 2 to 4 and Comparative Examples 1 to 4

In a similar manner to Example 1 except that the mold was changed to alter specifications of the dimples as presented in Table 1 and Tale 2 below, golf balls of Examples 2 to 4 and Comparative Examples 1 to 4 were obtained.

TABLE 1

Specifications of dimples

Figure 6:
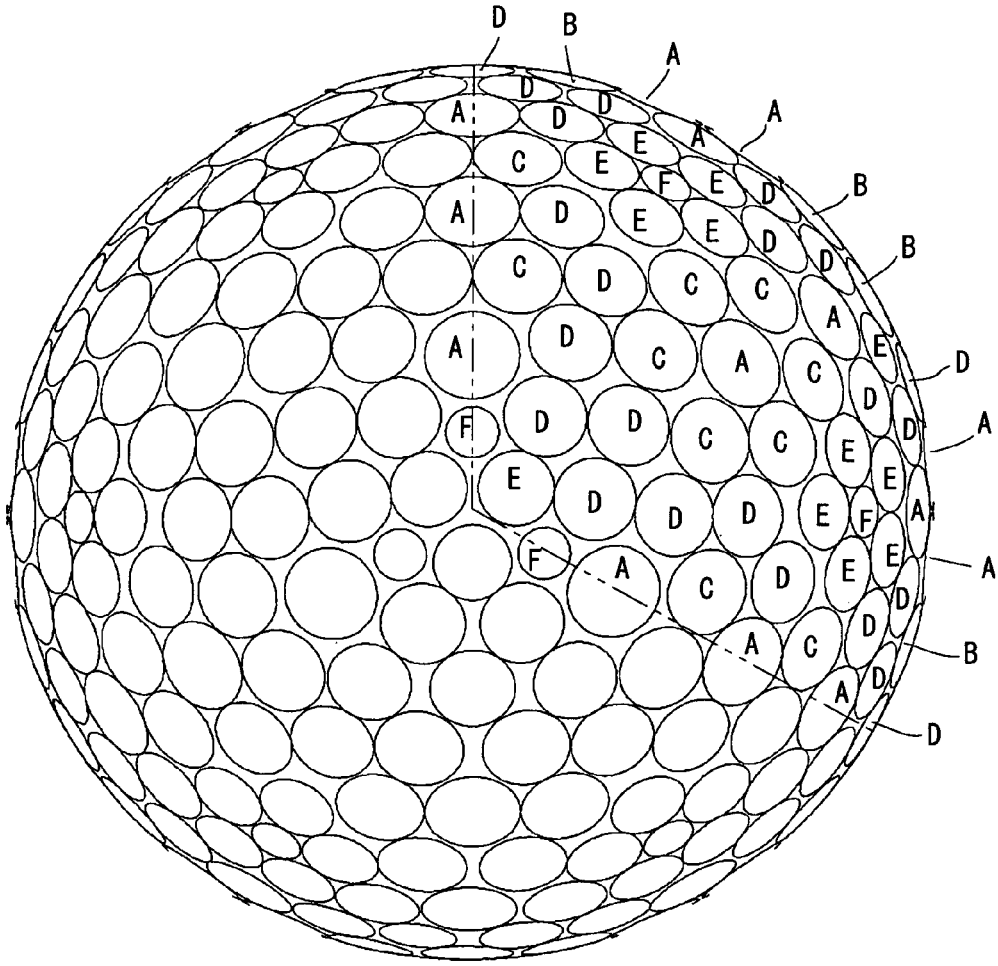
FIG. 6 is a plan view illustrating a golf ball according to an Example 2 of the present invention.
Figure 7:
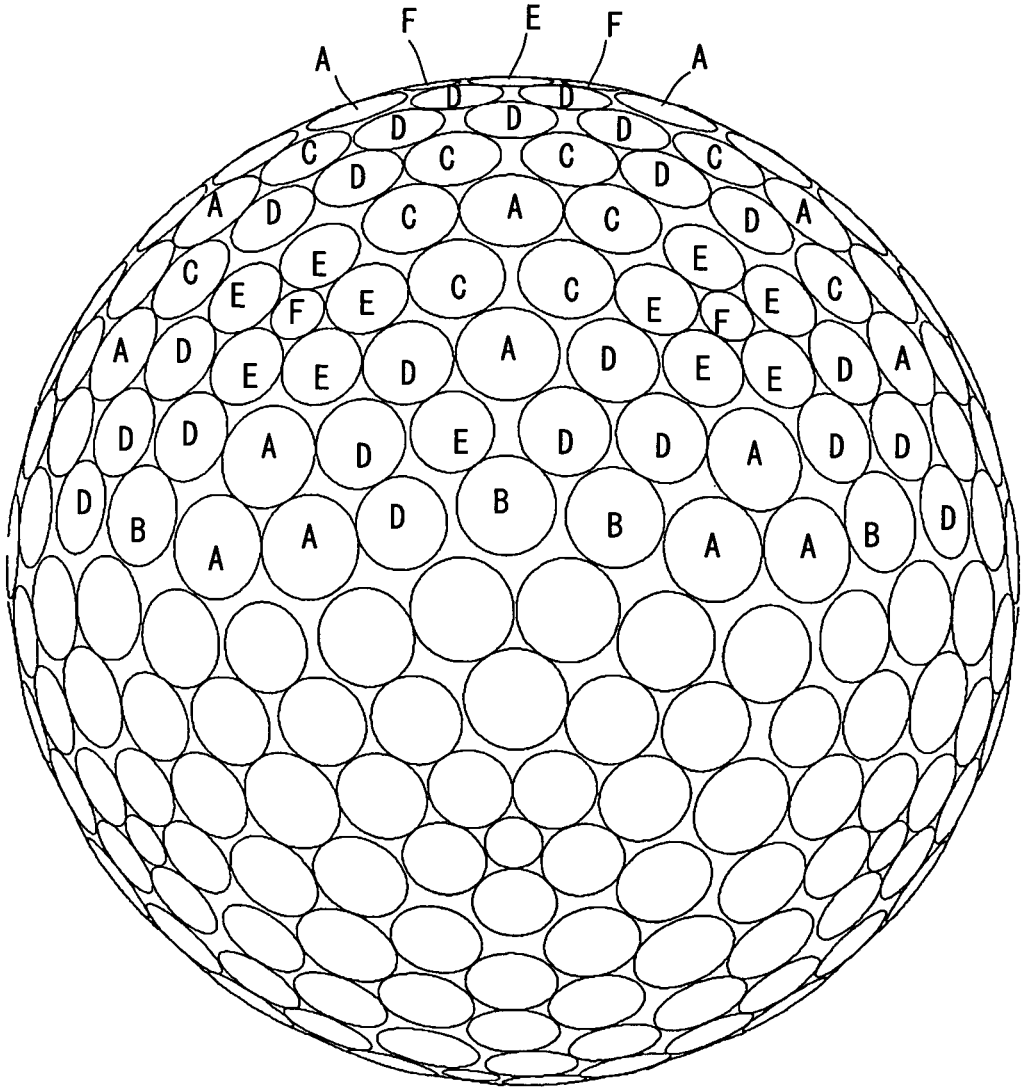
FIG. 7 is a front view illustrating the golf ball shown in FIG. 6.
Figure 8:
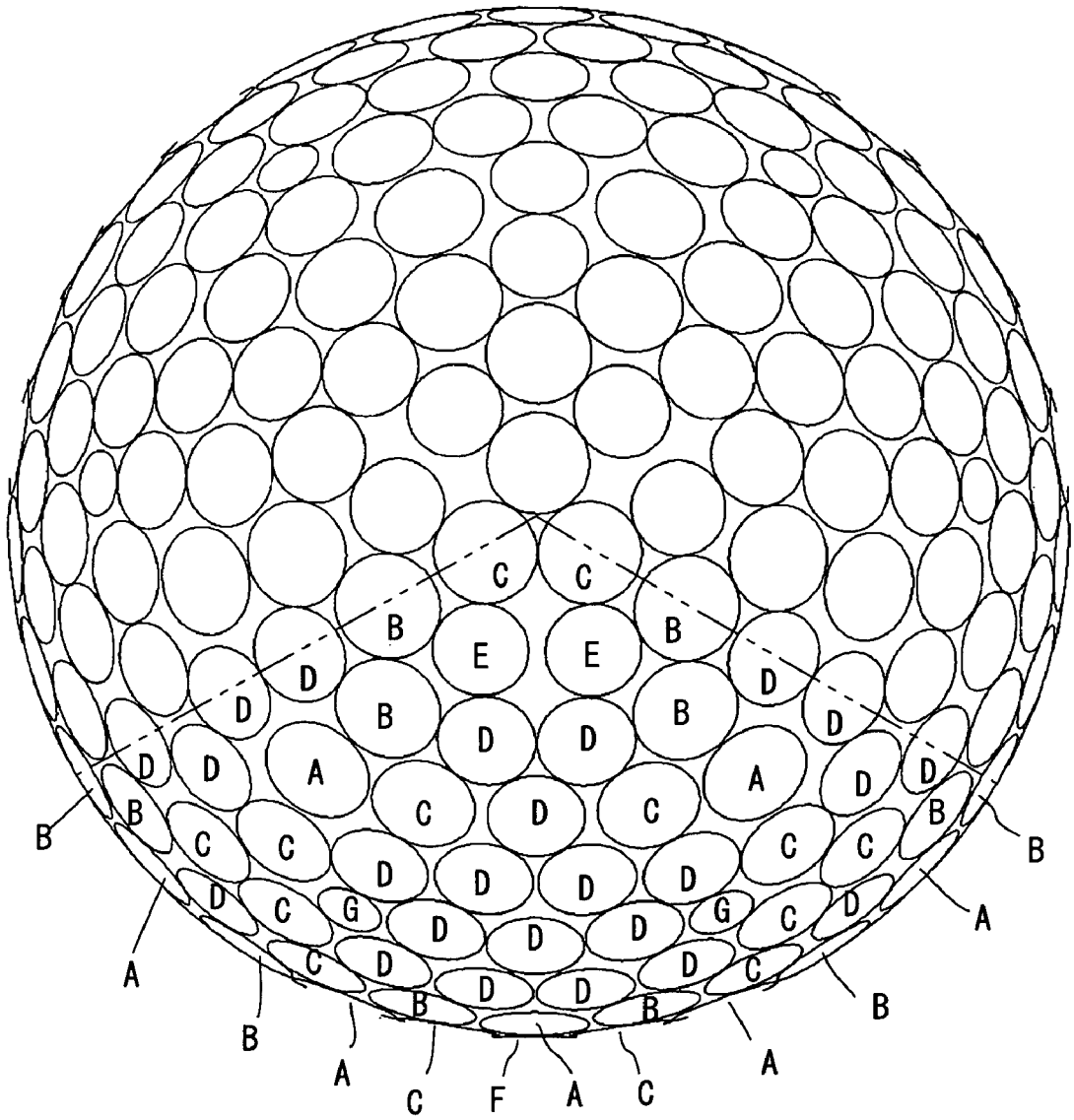
FIG. 8 is a plan view illustrating a golf ball according to Example 3 of the present invention.
Figure 9:
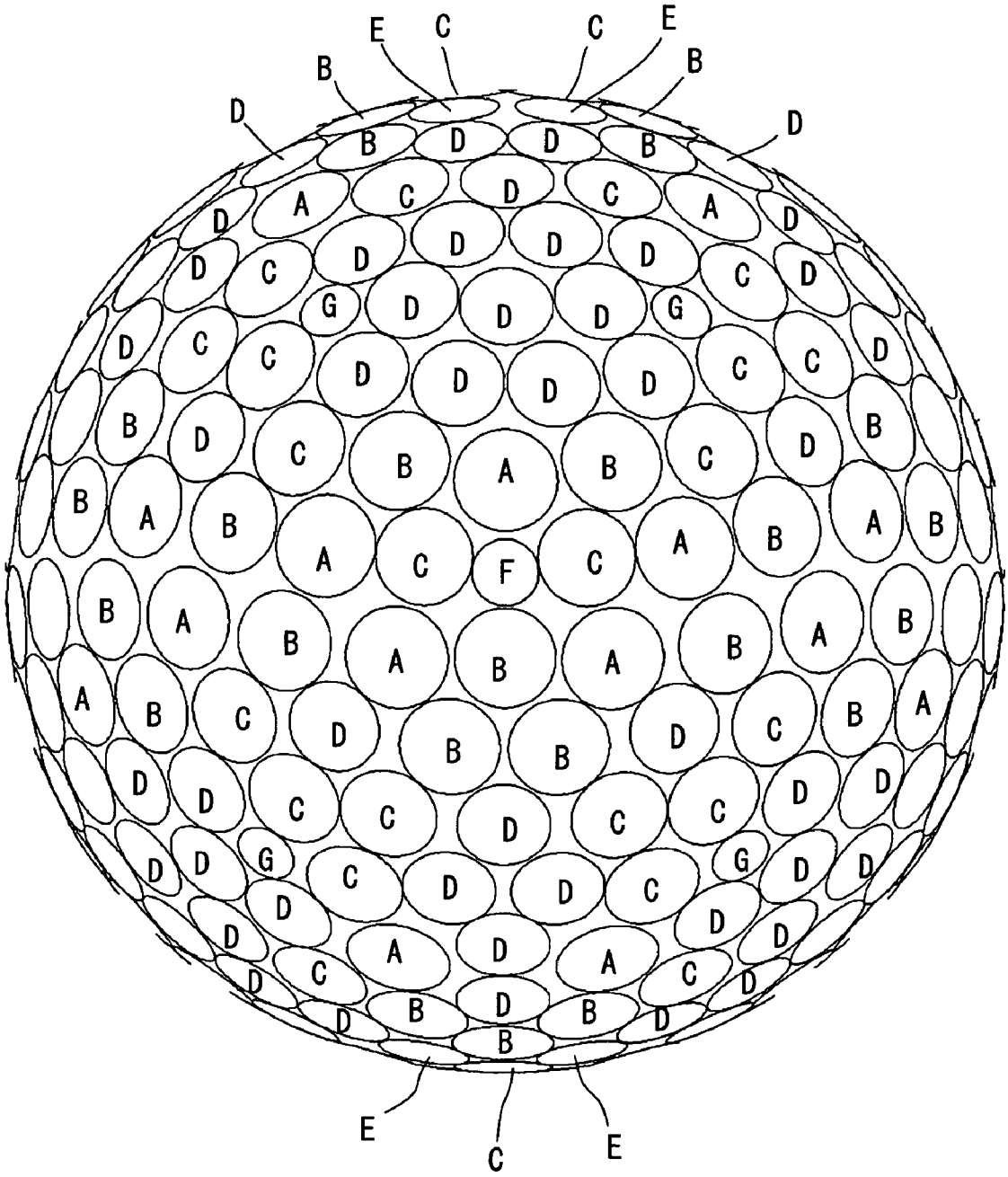
FIG. 9 is a front view illustrating the golf ball shown in FIG. 8.
Figure 10:
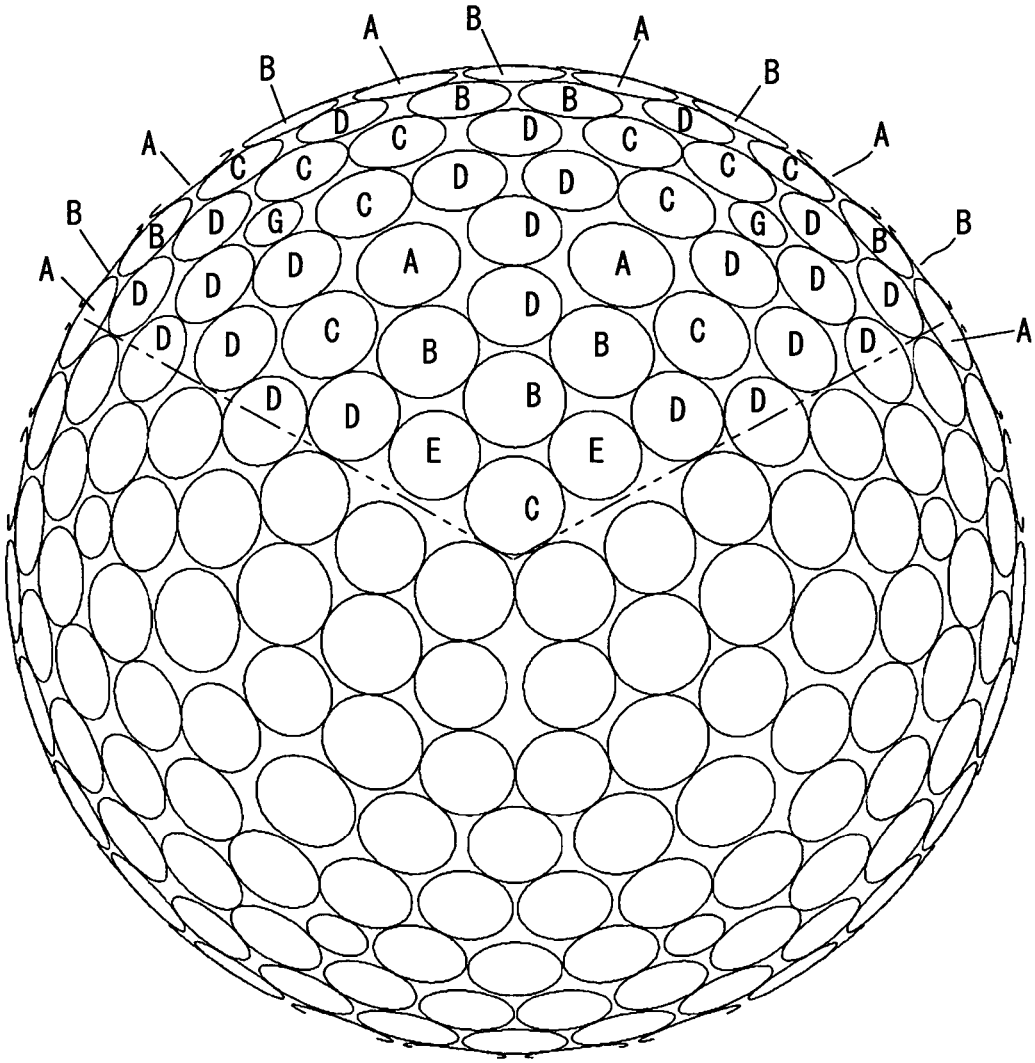
FIG. 10 is a bottom view illustrating the golf ball shown in FIG. 8.
Figure 11:
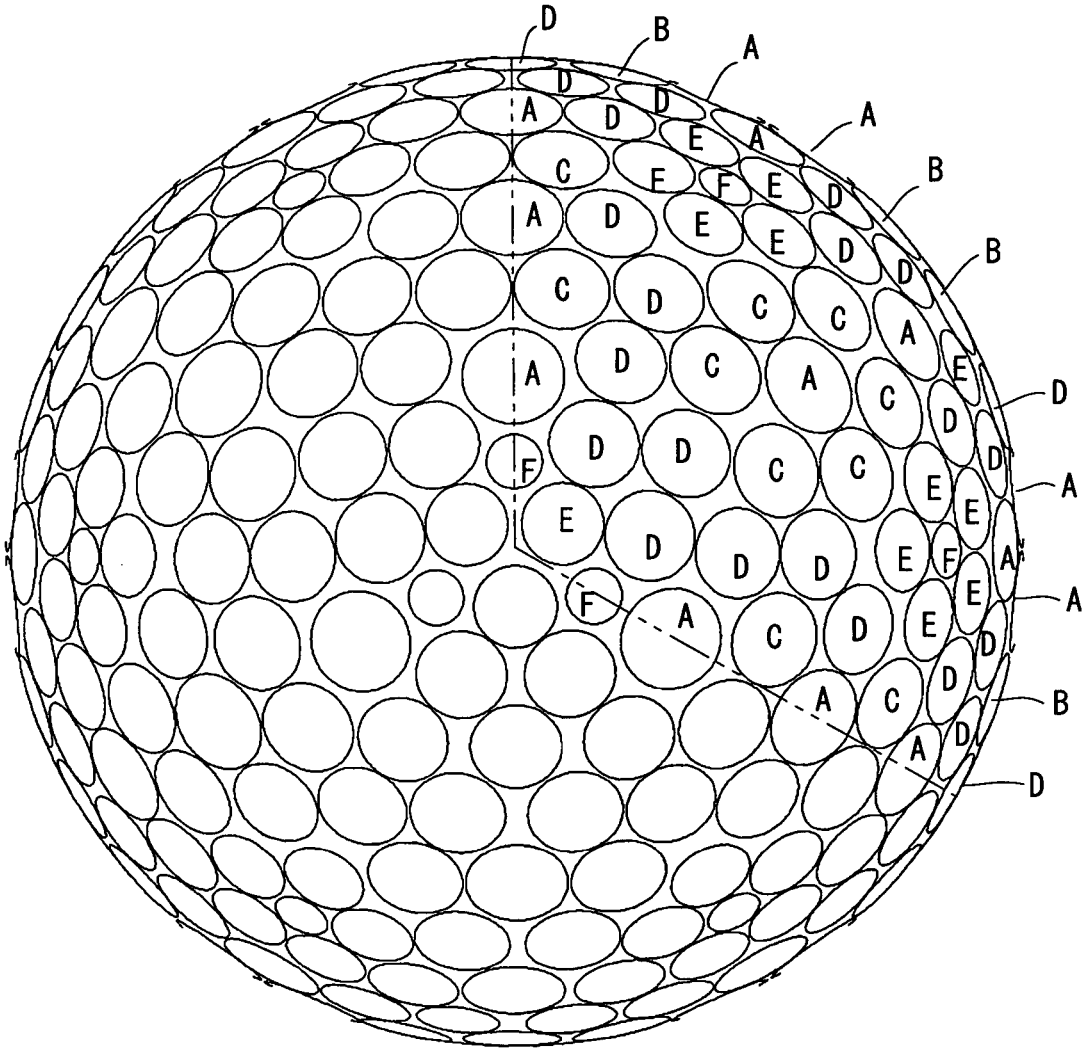
FIG. 11 is a plan view illustrating a golf ball according to Example 4 of the present invention.
Figure 12:
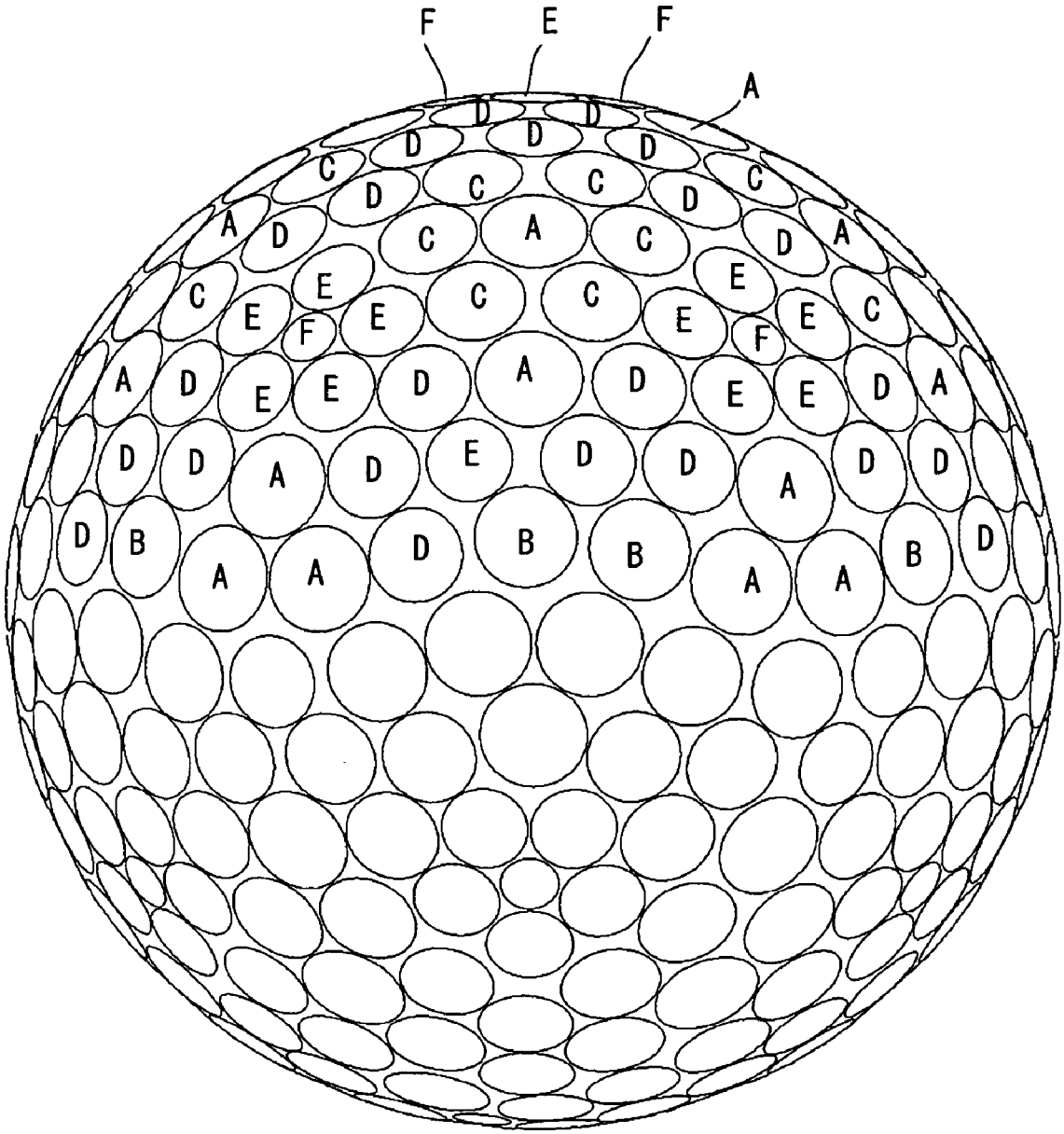
FIG. 12 is a front view illustrating the golf ball shown in FIG. 11.

| | Kind | Number | Diameter Di (mm) | Depth (mm) | Volume ($mm^3$) | Plane view | Front view | Bottom view |
|---|---|---|---|---|---|---|---|---|
| Example 1 | A | 42 | 4.65 | 0.135 | 1.148 | FIG. 2 | FIG. 3 | FIG. 4 |
| | B | 66 | 4.45 | 0.134 | 1.043 | | | |
| | C | 72 | 4.25 | 0.134 | 0.952 | | | |
| | D | 126 | 4.05 | 0.134 | 0.864 | | | |
| | E | 12 | 3.95 | 0.133 | 0.816 | | | |
| | F | 3 | 2.80 | 0.132 | 0.408 | | | |
| | G | 12 | 2.65 | 0.132 | 0.365 | | | |
| Example 2 | A | 66 | 4.55 | 0.135 | 1.099 | FIG. 6 | FIG. 7 | — |
| | B | 24 | 4.35 | 0.130 | 0.967 | | | |
| | C | 60 | 4.25 | 0.125 | 0.888 | | | |
| | D | 132 | 4.05 | 0.125 | 0.806 | | | |
| | E | 72 | 3.70 | 0.125 | 0.673 | | | |
| | F | 18 | 2.55 | 0.125 | 0.320 | | | |
| Example 3 | A | 42 | 4.50 | 0.137 | 1.091 | FIG. 8 | FIG. 9 | FIG. 10 |
| | B | 66 | 4.40 | 0.136 | 1.035 | | | |
| | C | 72 | 4.25 | 0.136 | 0.966 | | | |
| | D | 126 | 4.05 | 0.136 | 0.877 | | | |
| | E | 12 | 3.95 | 0.134 | 0.822 | | | |
| | F | 3 | 2.90 | 0.133 | 0.440 | | | |
| | G | 12 | 2.70 | 0.133 | 0.382 | | | |
| Example 4 | A | 66 | 4.40 | 0.140 | 1.066 | FIG. 11 | FIG. 12 | — |
| | B | 24 | 4.20 | 0.140 | 0.971 | | | |
| | C | 60 | 4.10 | 0.140 | 0.926 | | | |
| | D | 132 | 3.90 | 0.138 | 0.826 | | | |

TABLE 1-continued

| Specifications of dimples | | | | | | | |
|---|---|---|---|---|---|---|---|
| Kind | Number | Diameter Di (mm) | Depth (mm) | Volume ($mm^3$) | Plane view | Front view | Bottom view |
| E | 72 | 3.55 | 0.130 | 0.645 | | | |
| F | 18 | 2.400 | 0.125 | 0.284 | | | |

TABLE 2

Figure 13:
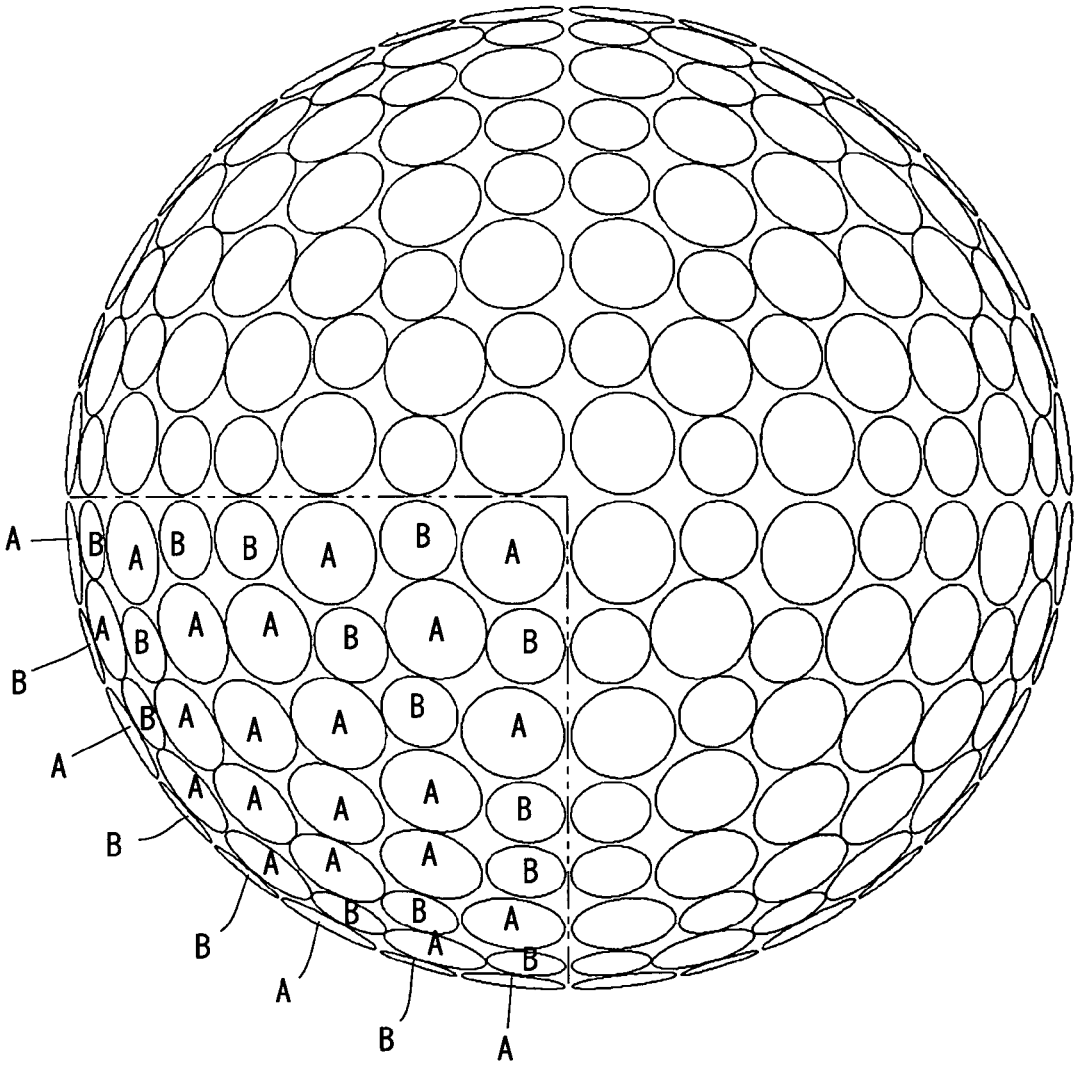
FIG. 13 is a plan view illustrating a golf ball according to Comparative Example 1.
Figure 14:
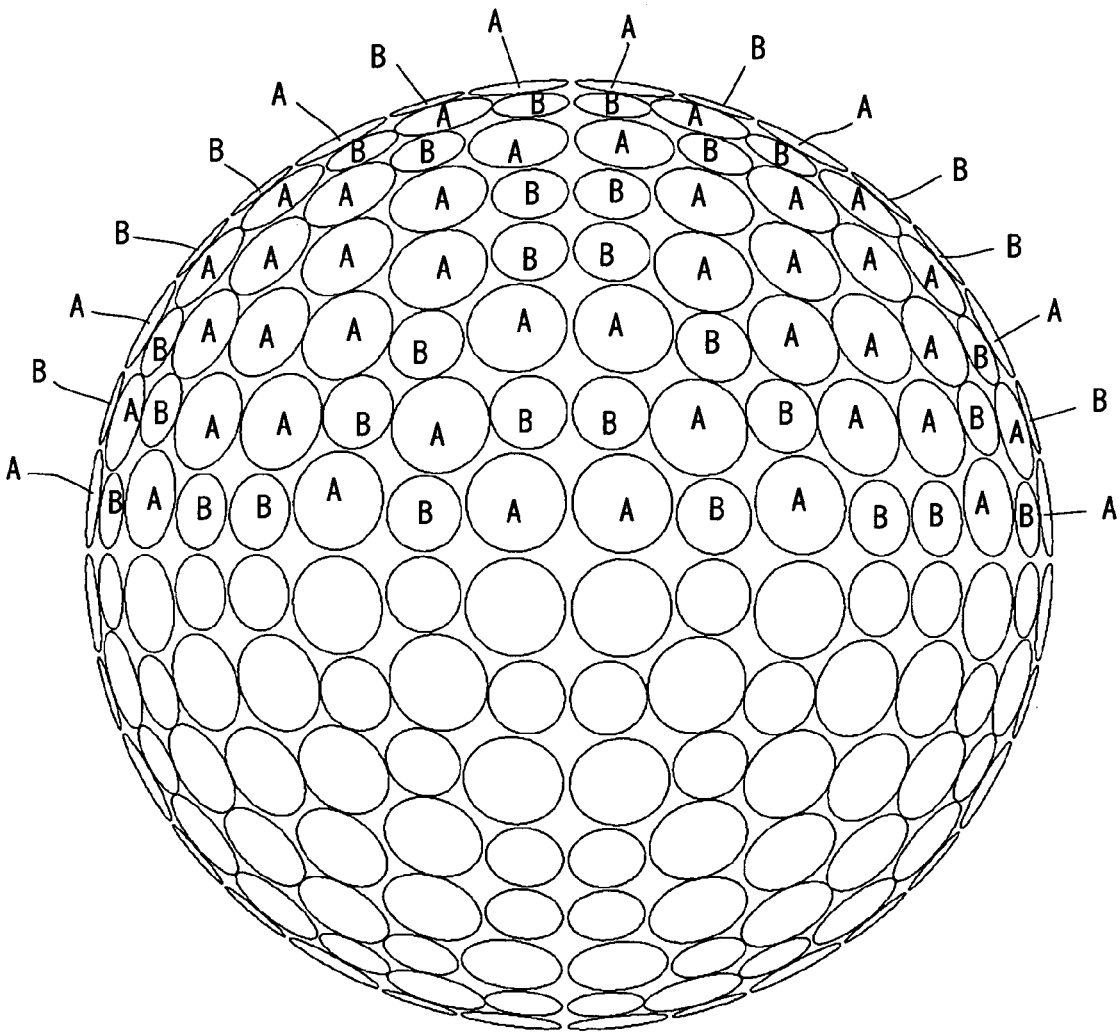
FIG. 14 is a front view illustrating the golf ball shown in FIG. 13.
Figure 15:
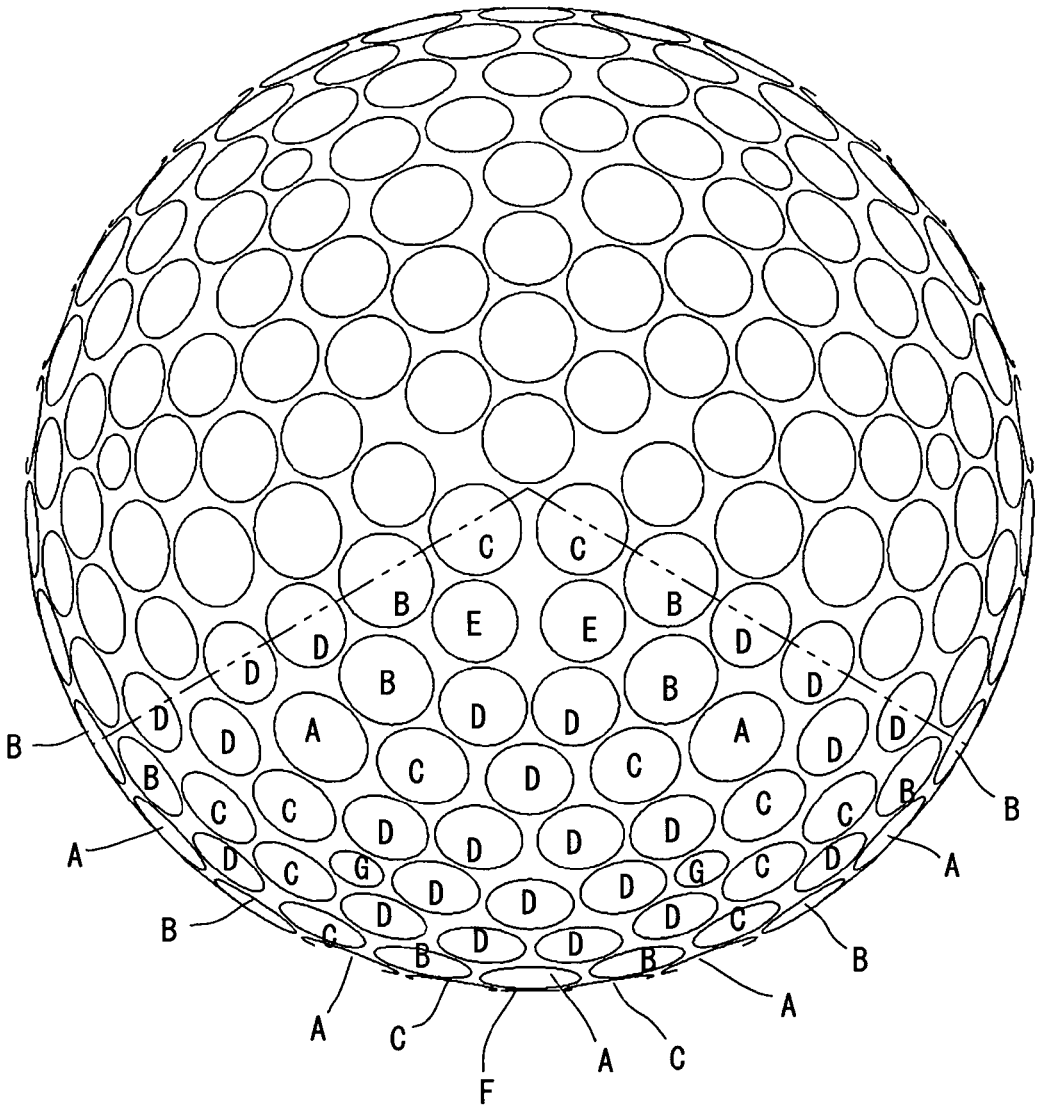
FIG. 15 is a plan view illustrating a golf ball according to Comparative Example 2.
Figure 16:
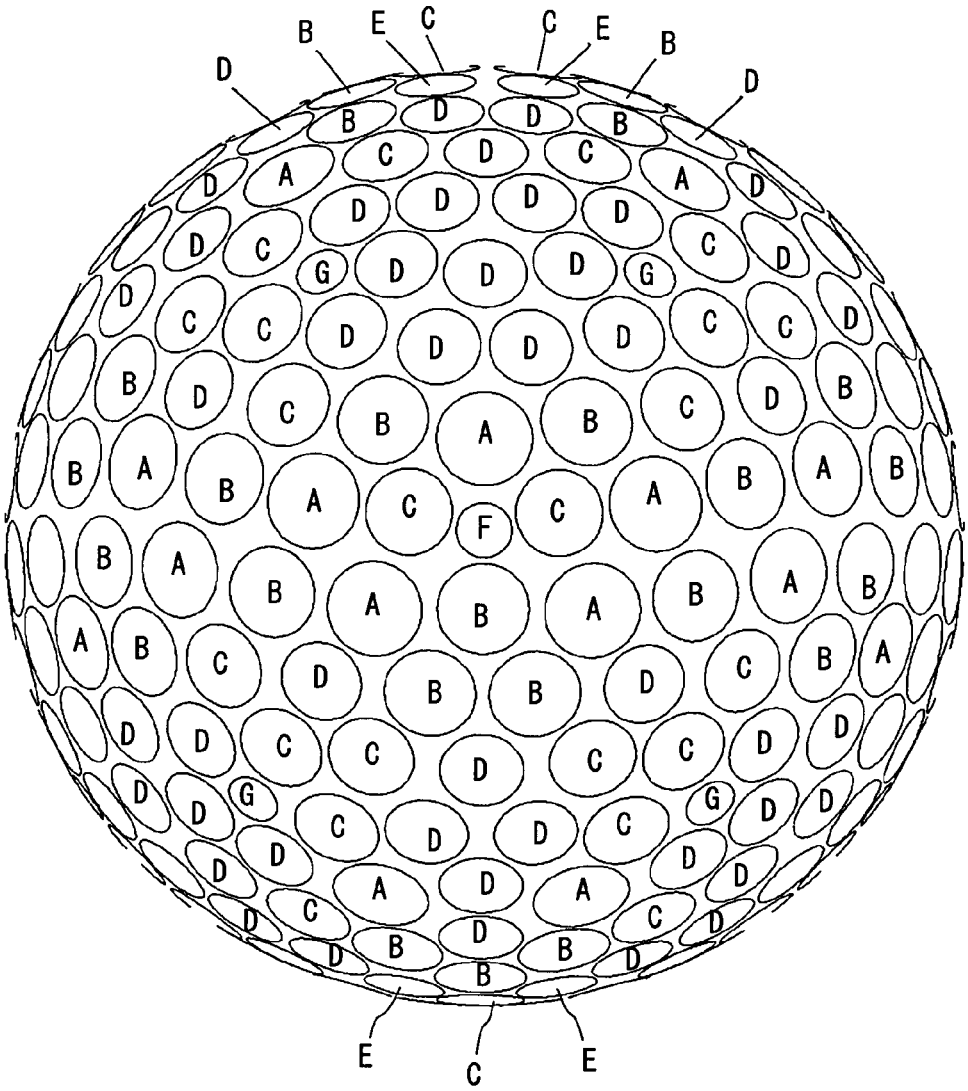
FIG. 16 is a front view illustrating the golf ball shown in FIG. 15.
Figure 17:
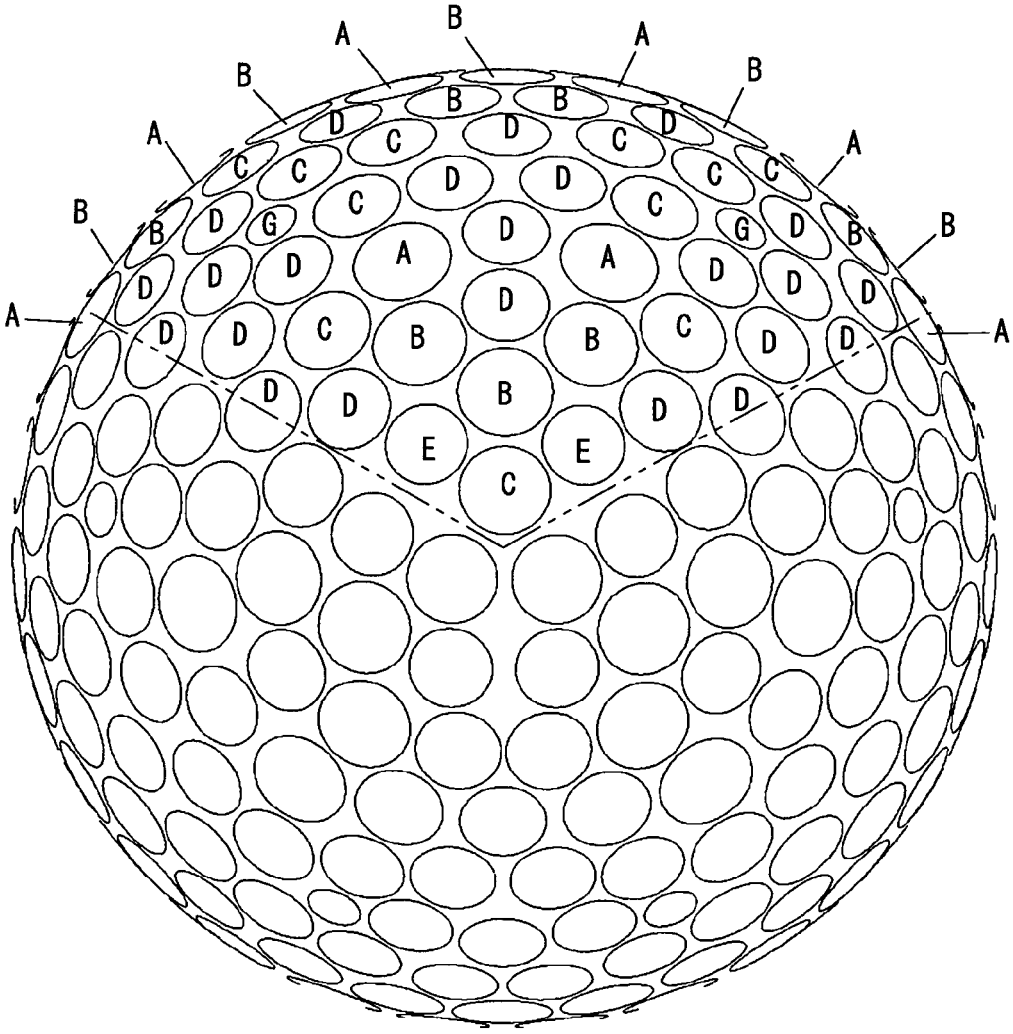
FIG. 17 is a bottom view illustrating the golf ball shown in FIG. 15.
Figure 18:
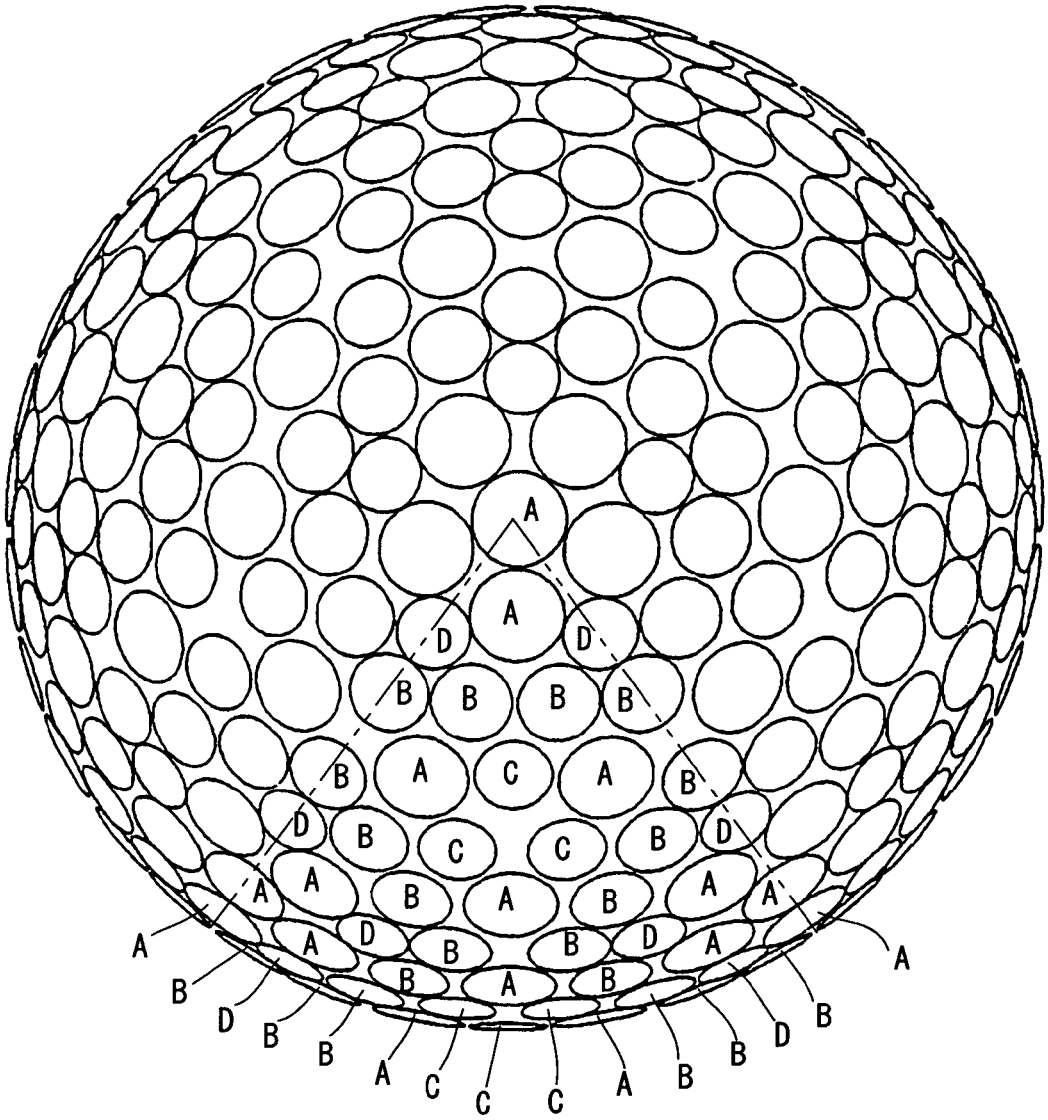
FIG. 18 is a plan view illustrating a golf ball according to Comparative Example 3.
Figure 19:
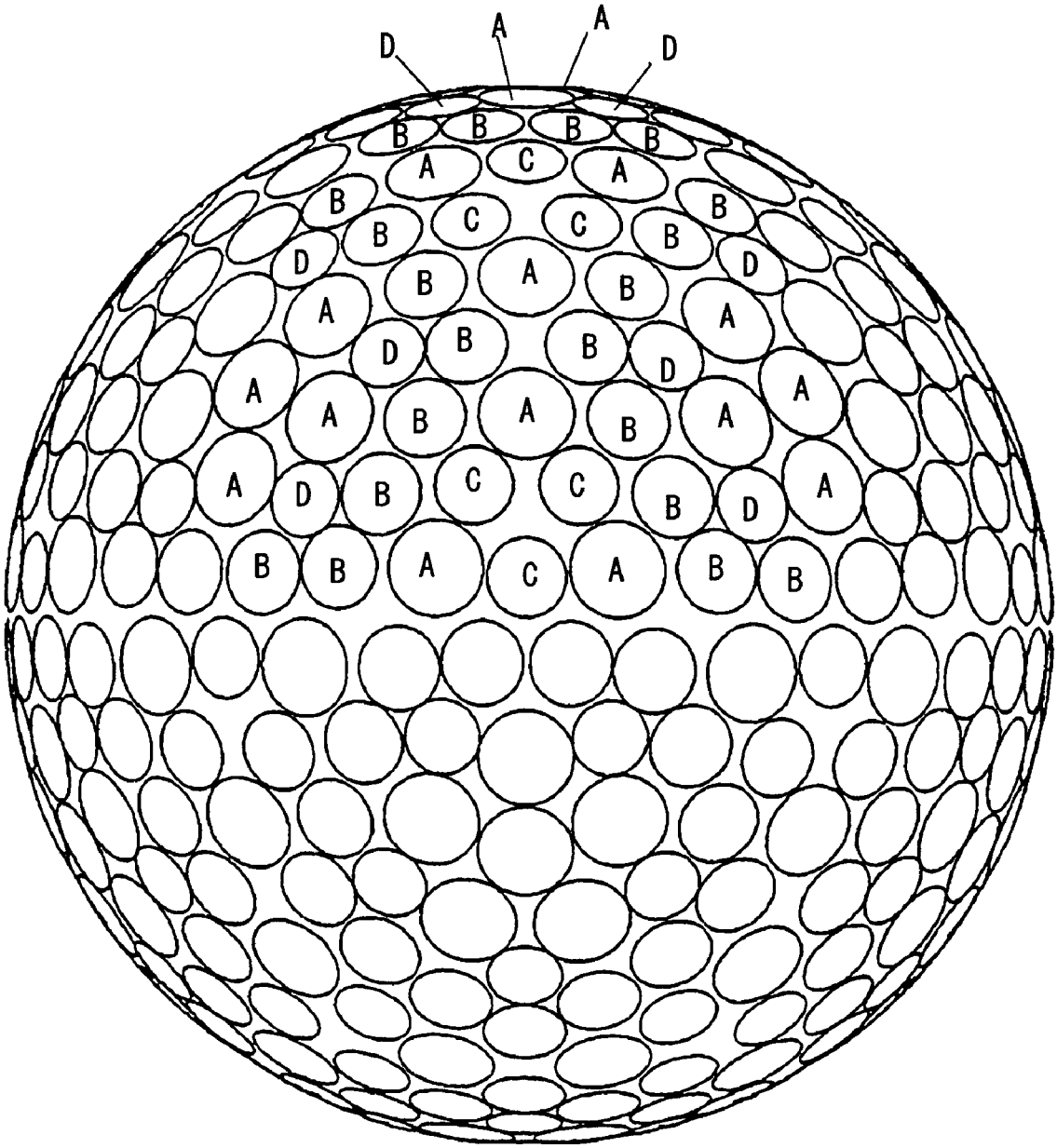
FIG. 19 is a front view illustrating the golf ball shown in FIG. 18.
Figure 20:
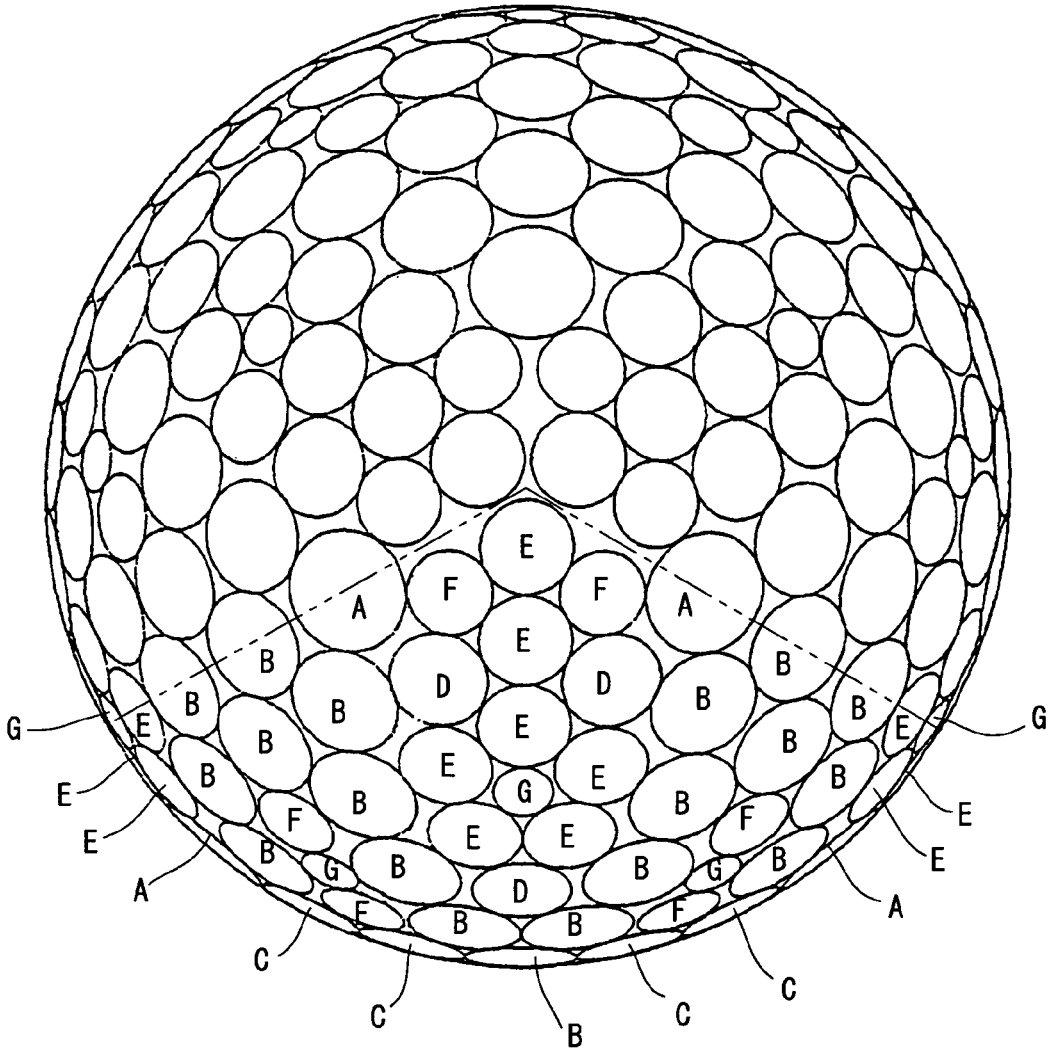
FIG. 20 is a plan view illustrating a golf ball according to Comparative Example 4.
Figure 21:
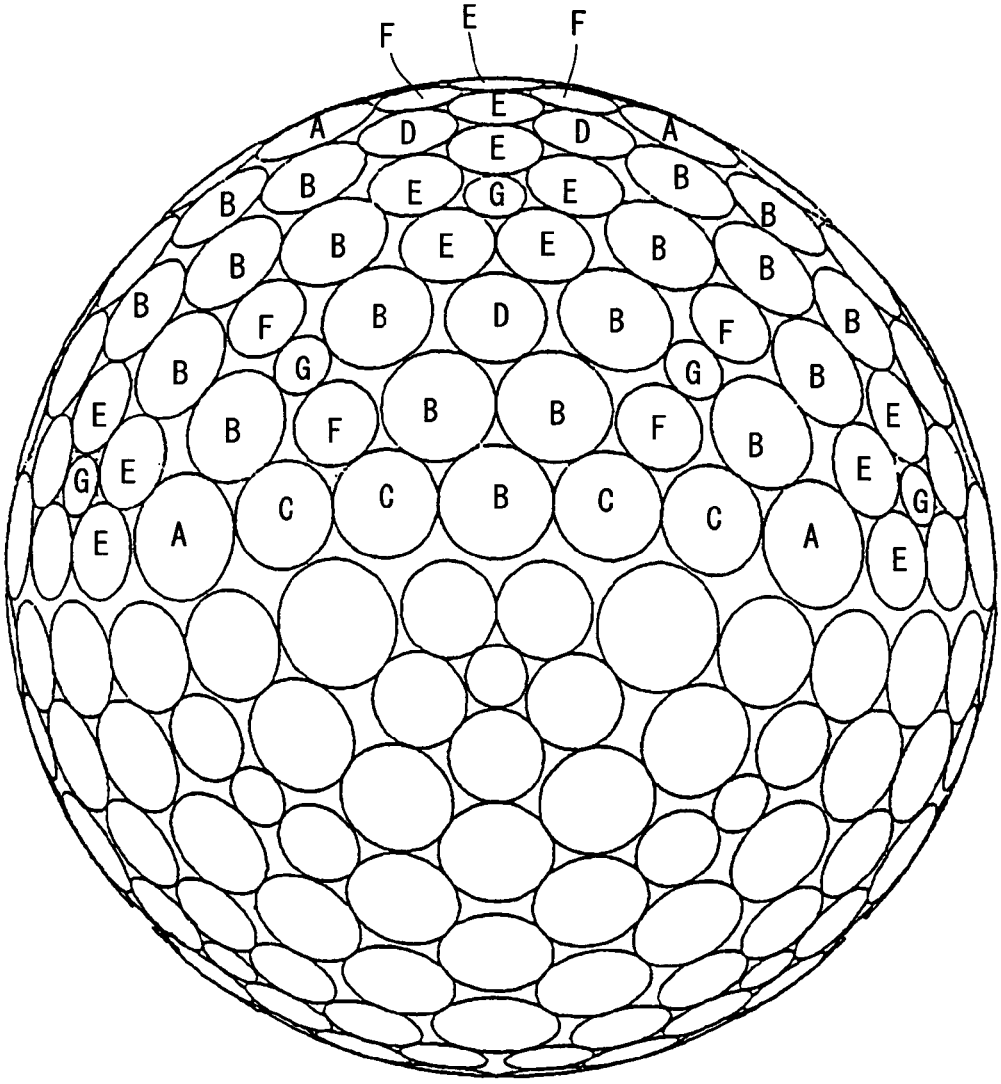
FIG. 21 is a front view illustrating the golf ball shown in FIG. 20.

| Specifications of dimples | | | | | | | | |
|---|---|---|---|---|---|---|---|---|
| | Kind | Number | Diameter Di (mm) | Depth (mm) | Volume ($mm^3$) | Plane view | Front view | Bottom view |
| Com. Example 1 | A | 192 | 4.50 | 0.141 | 1.123 | FIG. 13 | FIG. 14 | — |
| | B | 144 | 3.45 | 0.140 | 0.656 | | | |
| Com. Example 2 | A | 42 | 4.35 | 0.160 | 1.191 | FIG. 15 | FIG. 16 | FIG. 17 |
| | B | 66 | 4.15 | 0.160 | 1.084 | | | |
| | C | 72 | 3.95 | 0.155 | 0.952 | | | |
| | D | 126 | 3.75 | 0.151 | 0.836 | | | |
| | E | 12 | 3.65 | 0.150 | 0.787 | | | |
| | F | 3 | 2.50 | 0.150 | 0.370 | | | |
| | G | 12 | 2.40 | 0.150 | 0.341 | | | |
| Com. Example 3 | A | 132 | 4.10 | 0.141 | 0.931 | FIG. 18 | FIG. 19 | — |
| | B | 180 | 3.55 | 0.132 | 0.654 | | | |
| | C | 60 | 3.40 | 0.132 | 0.601 | | | |
| | D | 60 | 3.25 | 0.133 | 0.553 | | | |
| Com. Example 4 | A | 18 | 5.60 | 0.131 | 1.614 | FIG. 20 | FIG. 21 | — |
| | B | 102 | 5.10 | 0.128 | 1.307 | | | |
| | C | 24 | 4.85 | 0.128 | 1.185 | | | |
| | D | 18 | 4.50 | 0.127 | 1.011 | | | |
| | E | 72 | 4.25 | 0.126 | 0.891 | | | |
| | F | 36 | 3.90 | 0.127 | 0.761 | | | |
| | G | 24 | 2.75 | 0.127 | 0.379 | | | |

[Travel Distance Test]

A driver with a metal head (trade name "XXIO", available from Sumitomo Rubber Industries, Ltd., shaft hardness: X, loft angle: 9°) was equipped with a swing machine, available from True Temper Co. Then the golf ball was hit under the condition of the head speed being 49 m/sec, the launch angle being approximately 11°, and the initial spin rate being approximately 3000 rpm. Accordingly, the distance from the launching point to the point where the ball stopped was measured. Under the condition during the test, it was windless. Mean values of 20 times measurement are shown in Table 3 below.

TABLE 3

| Results of evaluation | | | | | | | | |
|---|---|---|---|---|---|---|---|---|
| | Example 1 | Example 2 | Example 3 | Example 4 | Com. Example 1 | Com. Example 2 | Com. Example 3 | Com. Example 4 |
| Number of kinds of dimples | 7 | 6 | 7 | 6 | 2 | 7 | 4 | 7 |
| Total number of dimples | 333 | 372 | 333 | 372 | 336 | 333 | 432 | 294 |
| Total volume of dimples ($mm^3$) | 309.9 | 309.6 | 310.0 | 309.7 | 310.0 | 310.0 | 309.9 | 309.7 |
| Mean diameter of dimples (mm) | 4.18 | 4.05 | 4.16 | 3.90 | 4.05 | 3.89 | 3.66 | 4.53 |
| Occupation ratio (%) | 80.6 | 84.6 | 79.5 | 78.5 | 76.8 | 69.6 | 79.7 | 84.7 |
| Dx (mm) | 4.65 | 4.55 | 4.50 | 4.40 | 4.50 | 4.35 | 4.10 | 5.41 |
| Dn (mm) | 3.39 | 3.14 | 3.42 | 2.99 | 3.45 | 3.11 | 3.25 | 2.95 |
| Dx/Dn | 1.37 | 1.45 | 1.32 | 1.47 | 1.30 | 1.40 | 1.26 | 1.84 |
| $\eta$ | 0.39 | 0.43 | 0.35 | 0.43 | 0.52 | 0.38 | 0.31 | 0.72 |
| Travel distance (m) | 240.2 | 239.1 | 238.5 | 237.0 | 234.9 | 235.7 | 235.4 | 236.1 |

As is shown in Table 3, the golf balls of Examples are excellent in the flight performance. Accordingly, advantages of the present invention are clearly indicated by these results of evaluation.

The dimple pattern according to the present invention is suitable for not only two-piece golf balls, but also one-piece golf balls, multi-piece golf balls and wound golf balls. The description herein above is just for one example, and therefore, various modifications can be made without departing from the principles of the present invention.

What is claimed is:

1. A golf ball which comprises three different kinds of dimples, each having a different diameter, on the surface thereof, the occupation ratio of the total area of the dimples in the surface area of a phantom sphere being equal to or greater than 75%, the Dx/Dn ratio being equal to or greater than 1.36, when the mean diameter of the dimples having a diameter ranking in the top 10% of the diameters of all the dimples is defined as Dx and the mean diameter of the dimples having a diameter ranking in the bottom 10% of the diameters of all the dimples is defined as Dn, and the standard deviation $\eta$ of diameters of all the dimples being equal to or less than 0.43.

2. The golf ball according to claim 1 wherein the mean value of the diameters of all the dimples is equal to or greater than 4.00 mm.

3. The golf ball according to claim 1 which comprises five or more kinds of dimples, each having a different diameter, disposed on the surface thereof.

4. The golf ball according to claim 1 wherein the standard deviation $\eta$ is equal to or less than 0.40.

* * * * *